United States Patent [19]

Pellegri et al.

[11] 4,088,556

[45] May 9, 1978

[54] MONITORING MOVING PARTICLE ELECTRODES

[75] Inventors: Alberto Pellegri, Luino (VA); Rinaldo Santi, Milan, both of Italy

[73] Assignee: Diamond Shamrock Technologies, S.A., Geneva, Switzerland

[21] Appl. No.: 835,155

[22] Filed: Sep. 21, 1977

[51] Int. Cl.[2] ..... C25D 17/12

[52] U.S. Cl. ..... 204/222; 204/223

[58] Field of Search ..... 204/222, 223

[56] References Cited

U.S. PATENT DOCUMENTS

| | | | |
|---|---|---|---|
| 3,420,766 | 1/1969 | Michelson | 204/223 |
| 3,649,490 | 3/1972 | Nolan et al. | 204/223 |
| 3,974,049 | 8/1976 | James et al. | 204/222 |
| 3,994,796 | 11/1976 | Mayer | 204/223 |

*Primary Examiner*—R. L. Andrews

*Attorney, Agent, or Firm*—John P. Hazzard

[57] ABSTRACT

The operation of a moving particle electrode in an electrolytic cell is monitored by detecting vibration or displacement created by impingment of the solid moving particles against a solid surface producing a signal or alarm whenever the vibration or displacement decreases or otherwise changes an undesirable degree. Vibration or displacement decrease is caused by reduced movement of the particles associated with or part of the electrode.

18 Claims, 6 Drawing Figures

MONITORING MOVING PARTICLE ELECTRODES

BACKGROUND OF THE INVENTION

This invention relates to the monitoring of the operation of an electrolytic cell particularly a plurality of cell units of one or a plurality of cells having an electrode comprising a plurality of moving electroconductive particles which either serve and act as the electrode itself or are continuously or intermittently and successively in electronic contact with a parent electrode and thereby produce an electrochemical reaction. This reaction may involve generation of electricity as in a battery or may involve a chemical reaction producing or releasing an element or compound, for example chlorine, electrodeposited metal, etc.

It is known to conduct electrochemical reactions in a cell having an electrode comprising a plurality of electroconductive particles. Thus, U.S. Pat. No. 3,879,225 granted to J. R. Backhurst et al., describes and illustrates a cell wherein a fluidized bed of conductive particles is established in a contact with a parent electrode or conductor to conduct an electrochemical reaction. The particles are supported by an upward flow of electrolyte and move about continuously to establish a bed of moving particles which may be continuously or periodically in electrical contact with each other and/or with the parent electrode and the bed of moving particles effectively becomes, or may be regarded as, the electrode since the electrodic reaction eventually or even continuously takes place on the surface of the tumbling particle at least while it is in contact with the parent electrode or conductor. Various other patents describe other electrodes comprising moving particles including but not limited to the following:

| U.S. Pat. No. | BRITISH |
|---|---|
| 3,981,787 | |
| 3,887,400 | 1,098,837 |
| 3,902,918 | |
| 1,789,443 | |
| 3,703,446 | |
| 3,654,098 | |
| 3,781,787 | |

The body of particles need not be in the form of a fluidized bed which usually comprises a body of tumbling, bouncing, or dancing particles with a well-defined upper surface and more or less uniform density. It may also comprise a moving stream or layer of particles flowing along an inclined parent electrode or a wall or may even comprise a circulating stream of particle slurry which flows in a path along parent electrode or conductor. One advantage of this type of electrode, the moving particulate electrode, is that an increased area of electrochemically active electrode surface is provided due to the high exposed surface area of the electrode particles.

In the operation of this type of cell, it is desirable that the density of the bed (number of particles per unit volume of active area) be maintained relatively uniform or that the rate of movement be maintained continuously and settling minimized and thus that particle movement be maintained at least within a certain degree of control.

Several problems may arise:

For example, irregular flow of fluid medium producing the particle movement may develop through blockage of parts thus causing channeling and producing a bed of varying particle population or density from one side to the other of an electrode bed. A change in particle density or size, for example, in electrodeposition, may induce the particles to settle thus lowering the effective height of the bed. These are only some of the factors which cause variation.

This variation may thus occur across the width of the electrode as where one side or a central area is less dense than another, due for example to variation in velocity of the upward lifting fluid stream. It may also occur from top to bottom of the bed particularly where the particles change in diameter or individual weight or density during the reaction and thus tend to seek a different level in the upwardly moving stream.

The problem of monitoring such variation becomes increasingly complicated when a plurality of cells are used. For example, a plurality of cell units may be aligned in electrical series and the number of units may even be in the hundreds. Since the cell tanks or enclosures are usually opaque monitoring of the many cells may be difficult.

SUMMARY OF THE INVENTION

According to this invention, methods and cells having moving particle electrodes or beds thereof and cell units have been provided with a simple and effective means to monitor their operation. These cells include a bed, layer, slurry or other body of moving conductive particles and in the course of movement, the particles ultimately come into contact with a parent conductor, electrode or voltage source. Thus, the bed itself or a substantial part thereof, may be effectively considered as the electrode.

A suitable monitoring device is provided with response to the particle movement of the electrode bed particles or of a particular area thereof or to the variation generated by such movement. This response is then converted (electrically or otherwise) to a signal, for example, to a signal which deactivates or activates a light or sounds an alarm or activates other means to alert a cell operator whenever the particle movement of the electrode area monitored changes in degree, density, or height of movement or falls or rises to some undesirable level, for example, when particle content falls undesirably to zero or the particles cease to move in a localized area of a cell unit or in a cell unit overall.

For example, the monitor may be responsive to vibration created by impact of moving solid particles againt a solid surface such as a pin or rod in the path of the moving particles. The monitoring means may alternatively be responsive to displacement of a hinged or pivoted solid such as a pin, plate, strip or rod which movement or displacement is produced by the continuous flowing of a stream of particles against it in a constant direction.

Mechanical vibration produced by such impact whether in the range of sound vibration or of lower frequency as well as displacement of a solid may then be converted readily to the desired signal by means well understood in the art. For example, an electromotive force may be generated from the resultant vibration which is in response to and if desired in proportion to the particle movement. This force may maintain an alarm circuit inactive so long as the desired degree of particle movement persists. However, if such movement stops or decreases to an undesirable degree the electromotive force diminishes or otherwise changes so that a switch or other means is activated to sound an alarm, turn on or to extinguish a light or otherwise to create a warning signal.

The same actuating signal may be conveniently derived from a proximity sensor sensing the displacement of a movable member. For example, a pin or strap may be pivoted in a central zone so that impact or bombardment of the particles causes movement of one end of the pin with other free end in contact or communication with the sensor. When the particles cease to cause displacement of the pin about the pivot, the pin falls back to change the placement of the other end of the pin thus activating the sensor.

The invention is especially effective where a plurality of cell units are used since the particulate bed (electrocde) or an area of each individual cell unit may be provided with individual monitors (pins, microphones, etc.) and individual responsive signal circuits (lights, etc.). Thus a plurality of cell units may be operated and defective operation, e.g. nonuniform particle flow, etc., in each individual cell unit readily detected.

BRIEF DESCRIPTION OF THE DRAWINGS

The invention will be more fully understood by reference to the following description referring to the following drawings in which.

DESCRIPTION OF THE PREFERRED EMBODIMENTS

Figure 1:
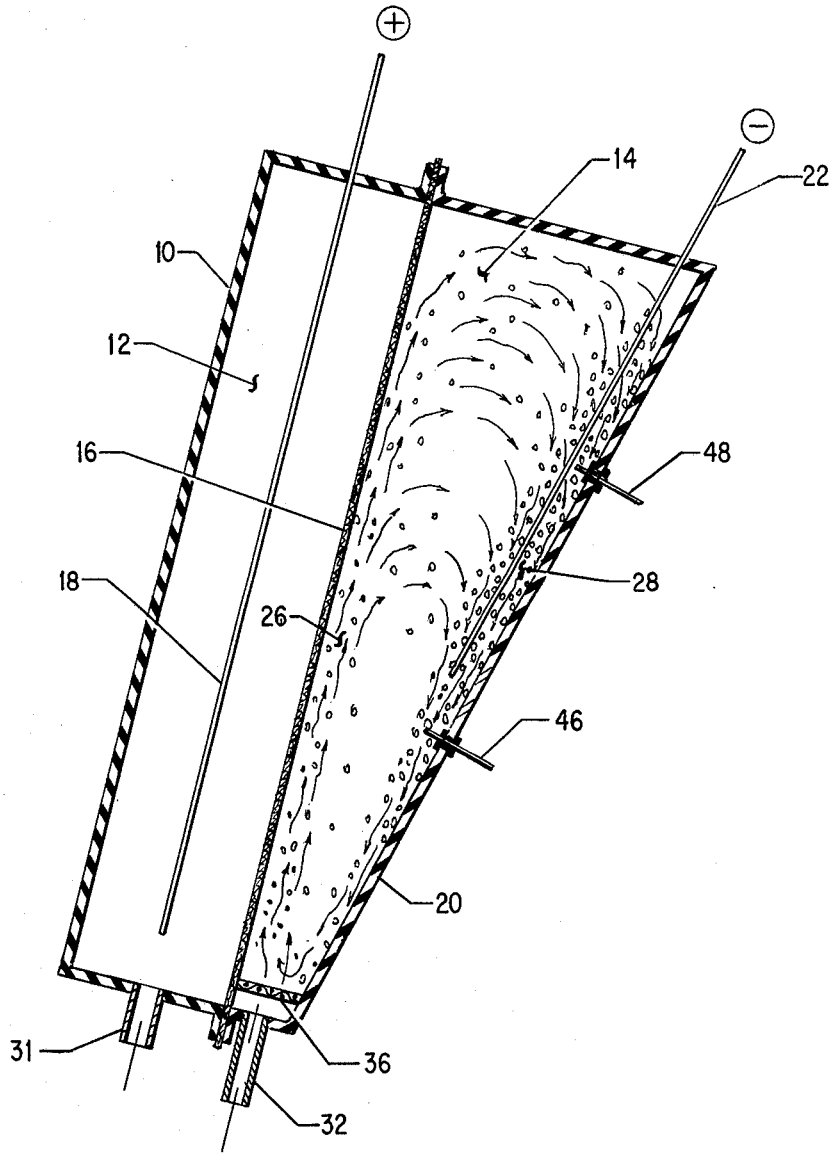
FIG. 1 is a diagrammatic side sectional view of a cell of the type herein contemplated.

FIG. 1 illustrates a cell having an anode compartment 12 and a cathode compartment 14 separated by a porous diaphragm 16 which may be an ion permeable membrane, for example of an anion or cation exchange resin or may be of other suitable diaphragm construction. As illustrated, the cell is inclined from the vertical and the anode 18 mounted in the anode compartment also is so inclined. The angle of inclination may be 5° to 30° from the vertical but may be at another convenient angle less than 45° from vertical.

The cathode compartment is in the form of a truncated wedge with the bottom or floor, being the small end of the wedge. The diaphragm 16 and wall 20 form the side walls of the compartment and extend upward with both walls at an angle from the vertical with a nonconducting wall 20 being inclined from the vertical at the greater angle usually not over 60° and rarely, if ever, in excess of 40° from the vertical so that the two side walls converge toward the bottom.

A parent cathode or sheet conduit or current feeder 22 extends downward from the roof to the cathode compartment and is spaced from, but is essentially parallel to wall 20, a distance sufficient to permit conductive cathode particles to slide down wall 20 but in contact with the conductor. Alternatively, the conductor may rest on or be embedded in or a part of wall 20.

The parent electrode may be in the form of a continuous sheet which extends across the compartment just short of opposed end walls. Alternatively and often more conveniently, it may be in the form of spaced strips which extend downward and are spaced from each other more or less uniformly across the space between opposed compartment end walls.

As a further alternate, these strips may project through an end wall and extend horizontally across the cell toward the opposite end wall. The floor, roof and outside walls are generally nonconducting. Separate inlets 31 and 32 introduce electrolyte respectively into the anode and cathode compartments and inlets for electrolyte (not shown) may be conveniently provided at or near the top of the respective compartment to restrain the particles from falling out of the compartment.

This cell may be conveniently used for electrodepositing metal, i.e. electrowinning metal in pulverulent form. In this case, electroconductive solid metal particles 40 are suspended in the catholyte to receive the electrodeposited metal, for example, copper or zinc from an aqueous solution of the corresponding chloride or sulfate salts thereof.

In operation, an electric potential is established between anode 18 and cathode current feeder 22, the anolyte compartment is filled with a suitable electrolyte and electrolyte or other upwardly rising fluid is circulated upwardly into the cathode chamber through pipe 32 at a rate sufficient to lift the heaviest of particles 40. Thus the upflowing electrolyte stream as well as the inclined configuration of the cathode compartment suspends cathode particles and produces an upward flowing stream of electrolyte with the particles suspended therein along the diaphragm 16 as shown by the upward arrows in FIG. 1, thereby creating a region 26 of electrolyte having a relatively low particle density and a relatively high upward catholyte rate of flow as compared to region 28, which region tends to remain less disturbed by the upward flowing catholyte, and thus to remain more compact (or even unexpanded) compared to the region 26 adjacent the membrane 16. In fact, the particles in region 28 tend to slide, flow or roll down the steeply inclined wall 20 generally in contact with one another and the parent electrode. Therefore, there is established a relatively dense downward moving bed or layer 28 of particles adjacent the wall 20 and feeder 22 which moves down toward the lower part of the cell as shown by the arrows adjacent wall 20, in FIG. 1.

Accordingly, particles are carried from the vicinity of the distributor screen 36 by the lifting force of the upward electrolyte stream of the catholyte up the low density region 26, eventually to drop from this region under gravity to the hig density region 28 at a plurality of levels.

Upward flow, if any, of catholyte up through the dense region 28 is not sufficient to carry a substantial portion of particles with it, and the particles in this region 28 therefore tend to slide down the wall 20 to replace those removed from the vicinity of the screen or distributor 36.

Not all particles are, however, carried to the top of the cathode compartment even in the low density region. Some drop out of the low density region 26 to join the high density region 28 at various levels up the cell, also shown diagrammatically by the arrows.

The particles in region 28 are essentially in electronic contact with one another, and hence with the current feeder 22 at all times or at least a major part of the time. In fact, this portion of this dense bed more or less encloses the feeder and is interposed between the feeder and the anode.

The electrode can be advantageously operated at an overall solids volume expansion (based upon volume of the particles bed when in static conduction) of less than 10 percent and preferably between 3 and 7 percent for optimum performance. Therefore, the height of the solid particles in the cell when no electrolyte is circulating is only slightly lower than below the height of the particle bed during electrolyte circulation. Of course, the bed may be expanded to greater volume say 50 to 100 percent above static height, if desired.

The preferred range of wedge taper angles is between 1:20 and 1:5, with the best taper angle being about 1:10. That is, when the wall 20 is inclined away from the separator by one inch for each 10 inches measured up the separator, the ratio is 1:10. The optimum wedge angle will ultimately depend on the height of the space occupied by the electrode particles.

An angle of inclination up to 10° from the vertical is conveniently employed, with the preferred angle being in the range 3° to 6°. (The angle of inclination is the angle of tilt of the steeper wall of the cell, i.e., the membrane 16, with respect to the vertical.)

These parameters will, however, best be determined by experiments for specific materials. The parameters will, for example, vary with the specific gravity and viscosity of the electrolyte and specific gravity and particle size distribution of the particles that are used, as well as the rate of upward flow adjacent wall 10.

In order to separate the larger particles which are to be won from an electrowinning process, a sieve (not shown) may be located at the top of the region 28 to catch particles flung out at the top of the low density region 26. This sieve may be of a mesh size suitable to return particles below a certain size to the dense region 28 and to retain the larger particles to be removed manually or otherwise from the cell.

In general, the size of the particles in the compartment ranges from about 25 to 3000 microns in diameter, the average particle size of all particles generally being in this range in any event. The mass of the dense portion 28 of the bed is in thickness several (3 or more) times the average particle diameter of the bed and may be several centimeters in thickness measured from the backwall toward the anode.

To monitor the movement along wall 20 a monitor pin or pins 48 and 46 are mounted in the wall 20 and project outwardly therefrom. Thus the pin projects into the path of the moving particles 40 as they move or slide down parallel to the wall 20. These pins are relatively small, rarely being in excess of 0.25 centimeters in diameter, and thus are small enough in bulk so that they vibrate in response to the impingement of particles against them. One or more pins may be disposed in a wall.

The locations of the pin is selected in accordance with the area of the bed of particles desired to be monitored. Thus pin 48 may be located at or near the top of the bed to provide a warning if the level of the bed begins to fall unduly. Also a pin or pins 46 may be located at a lower level for example, to detect channeling or localized bed defects. Also such pins may be spaced laterally (horizontally) at a convenient height across the width of wall 20.

Figure 2:
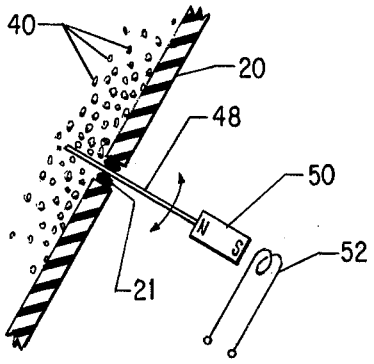
FIG. 2 is a diagrammatic detail view of one means for monitoring the cell of FIG. 1.

As illustrated in FIG. 2, the pins 46 and 48 extend through the wall 20 being supported and sealed by a soft elastomer gasket 21 which does not seriously dampen the pin vibration. The outer end of each pin terminates in a magnet 50 diagrammatically illustrated in FIG. 2. Associated with the magnet 50 is a coil 52. Consequently, vibration in the pin created by impingement of particles 40 at one end is transmitted to the other end vibrating the magnet and generating a small electromotive force in the coil. This electromotive force is then used to control a warning signal such as a light or other alarm. For example, as long as normal vibration and consequent electromotive force is generated, the alarm system remains inactive. Upon failure, however, the system is activated, for example, by closing an alarm switch normally held open by the generated electromotive force.

Figure 3:
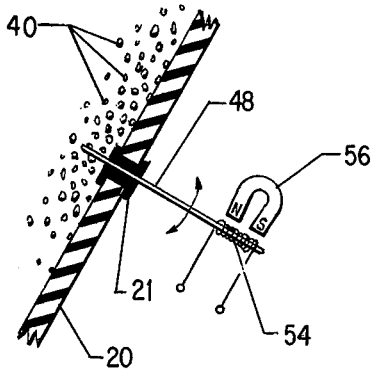
FIG. 3 is a diagrammatic view of a further embodiment of the monitor.

Various modifications can be resorted to. For example, as illustrated in FIG. 3, pin 48 (and pin 46) may be provided at its outer end with a coil 54 located in a magnetic field produced by magnet 56. In such a case, the e.m.f. is generated in coil 54 on the pin to establish control of the alarm system.

Alternately the pin assembly may be hinged, pivoted or otherwise mounted to allow the pin to deflect statically or dynamically under the force exerted by the downward stream of particles and the magnet and call pickup system may be conveniently replaced by a proximity switch sensing the displacement (or lack of displacement) of the free end of the pin.

Figure 4:
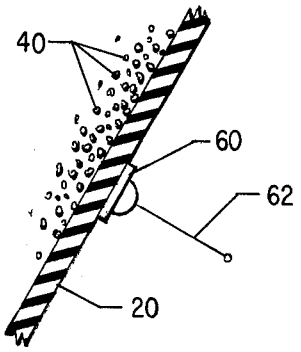
FIG. 4 is a diagrammatic view showing how a microphone may be used as a cell monitor.
Figure 5:
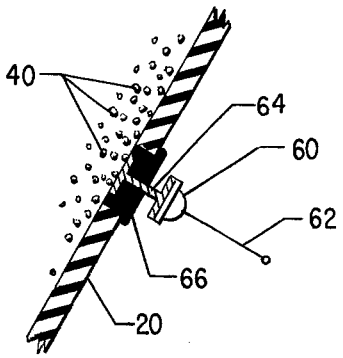
FIG. 5 is a diagrammatic view of a further embodiment involving the use of a microphone.

The microphone may be used to monitor the extent of particle movement as shown in FIGS. 4 and 5. Thus the microphone 60 may engage the wall 20 to pick up the sound vibrations created by particle movement and/or impingement as illustrated in FIG. 4 or microphone 60 may engage the outer flange of a metal channel 64 mounted in a soft elastomer gasket 66 which seals the opening and dampens surrounding vibration. The channel projects through the gasket and wall 20 directly into the path of particle movement and is relatively isolated from vibration created at other locations.

In each case, the microphone produces an electrical response transmitted by wire 62 to the alarm system.

Various readout systems for transmitting the e.m.f. generated by particle impingement may be resorted to. Since the art of readout systems is well-developed detailed description is unnecessary. Thus the signal may be amplified, changed in frequency for example, to pulsating direct current and the current produced subject to a low pass filter to remove effect of background noise created by other factors and then transmitted to a switch. Alternatively, it may be subjected to a low pass filter on both sides of the rectifier to filter background effects.

Figure 6:
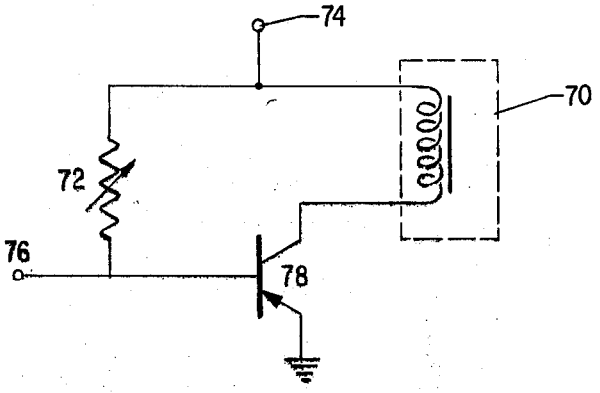
FIG. 6 diagrammatically illustrates a suitable circuit for operating a switch to turn on the alarm circuit.

Any switch such as that generally illustrated in FIG. 6 may be used. Thus the generated e.m.f. may be transmitted to a transformer 70 with the output of the transformer being connected to a variable resistor 78 and variable induction coil 72 which normally balances the e.m.f. generated in the transformer. Whenever the input electromotive force fails or falls or rises undesirably, an electromotive force is developed between points 74 and 76 which are connected to a light or other alarm thus creating the signal.

When a proximity switch is used instead of an electrodynamic pick-up, the off-on actuating signal is already available by action of the proximity switch itself without the need for filters and rectifying circuitry.

Another type of cell in which particle movement may be monitored by the methods described above appears, for example, in FIG. 2 and the related description of U.S. Pat. No. 3,956,086, incorporated herein by reference.

In such a cell, one or more microphones are mounted on or inset in the separator to monitor the level of the suspended bed and particle movement therein. This microphone has a diaphragm on surface against which particles may impinge and create a signal as generally illustrated in FIGS. 4 and 5 of the instant application. Several individual horizontally spaced microphones may be so mounted on or in the separator.

In the operation of such a unit the electrolyte flows upward through the cathode compartment suspending the cathode particles in contact with the feeder electrodes and expanding the height of the bed, for example, to 10–50 percent of its static height. The microphone is activated by particles impinging on its diaphragm. If any disturbance should cause failure of enough of the suspended particles to reach the height of the microphone diaphragm at the zone where it is installed, the microphone registers this failure and produces a warning signal as described above. If desired, a microphone may be installed above normal level to detect undesirable rise in the bed level.

The above cells and monitoring system may be used for widely varying purposes. They are especially useful for the electrodeposition of metals, e.g., copper or zinc upon relatively fine particles of these metals with the particles growing during electrodeposition by depositing the metal thereon and the larger particles being withdrawn and the finer particles recycled. In such event each unit is provided with one or more monitors. Monitoring devices such as microphones or the like may be disposed at various locations to monitor each individual unit cell. For example, a separate microphone may be disposed adjacent the cathode wall for each cell unit. If desired horizontally spaced separate monitoring devices may be disposed in a single unit cell. This may be resorted to in order to detect a difference in solids level or solids density at different points in the unit or to detect channeling of electrolyte.

Moveable detecting probes may be provided to be moved across a cell unit from one side to the other or upward and downward so that the cell may be monitored over its entire width and/or height with a single probe.

Also the monitoring devices may be disposed at different levels. In any event each monitor of each cell unit is connected to a seprate alarm light or other alarm unit.

Where a plurality of closely associated cell units are to be monitored, it may be advantageous to offset monitoring devices of the respective cell units so that the area monitored in one cell unit is offset horizontally or vertically from the monitoring station of the next adjacent cell units. This can serve to reduce the likelihood that a disturbance detected in one cell unit will also show up as a false defect in the next unit.

This monitoring system enables operation of an electrolytic cell of large size and even pluralities of cells or cell units in a simple manner without intense observation by the operator. Whenever the monitoring the system shows up defective operation, the operator's attention is promptly directed to the defect.

The cause of change of particle movement usually can be readily detected. For example, decrease in particle movement may indicate a blockage of particle flow and/or electrolyte flow which usually can be corrected manually. It may also indicate excessive particle size which can be adjusted by removing larger electrode particles and replacing with smaller particles.

Non-uniform electrolyte flow or flow of suspending or supporting fluid may occur and may be due to plugs which develop in distributors or in the lines supplying upward flowing electrolyte or other support fluid. Adjustment may be made by blowing out the plug, increasing or decreasing support flow, changing electrolyte density, etc.

Sometimes the level of particles may rise too high in the cell unit, for example, when the particle size of electrode particles is too small. This can usually be corrected by adding coarser particles or discontinuing large particle removal for a time or by reducing the rate of inflow of support fluid.

At all events pluralities of cell units may be operated with operating adjustments being made by the operator to individual cells while the others continue to operate. These adjustments are made in response to signals which are generated due to change in particle movement from a predetermined normal range. This change may reflect a localized decrease or increase in such movement or a change in level of particles or density of particles at a predetermined localum or level in a cell unit.

While cells herein disclosed have been described with particular reference to electrodepositing metal other reactions may be conducted using electrodes comprising or associated with suspended particles in an electrolyte. For example, the cell may serve as a battery in which the moving metal particles comprise the electrode being dissolved by electrochemical reaction and resulting voltage generation. See for example, U.S. Pat. No. 3,887,400 and others. Also the moving particular electrode may serve as the anode to produce anodic reactions such as generation of manganese dioxide. Furthermore both anode and cathode may comprise moving particles. In all of these cases particle movement of the electrode may be monitored as herein disclosed.

Although the present invention has been described with particular reference to the specific details of specific embodiments thereof, it is not intended that such details shall be regarded as limitations up the scope of the invention except insofar as included in the accompanying claims.

What is claimed:

1. An electrolytic cell comprising a cell tank and at least one pair of spaced opposed electrodes at least one of said electrodes comprising a body of moving electroconductive particles and at least one means to monitor the movement of said particles said monitoring means comprising means to produce a physical response to the particle movement and means to produce a signal whenever the magnitude of said response changes to a predetermined degree.

2. The cell claim 1 wherein the body of moving electroconductive particles is provided with at least two of said monitoring means which are spaced from each other and produce individual responses and individual signals in response to the movement of the body adjacent each respective monitor.

3. The cell of claim 2 wherein the monitoring means produces an electrical response in response to vibration or displacement produced by particle movement.

4. The cell of claim 1 wherein the physical response is vibration produced by movement of said particles and the signal is produced when the vibration produced diminishes.

5. The cell of claim 1 wherein the physical response is displacement of a probe produced by said particle movement and the signal is produced when the displacement produced diminishes beyond a predetermined degree.

6. The cell of claim 1 wherein the cell comprises a plurality of electrically communicating cell units each unit comprising a pair of opposed electrodes at least one of said electrodes comprising a body of moving electroconductive particles and each unit is provided with at least one individual monitoring means and individual means to produce a signal in response to the monitoring means.

7. A method of monitoring the operation of a plurality of electrolytic cells each of which comprises a cell unit having a pair of spaced electrodes at least one of said electrodes comprising a body of moving electroconductive particles in contact with a parent electrode which method comprises monitoring the cell unit to detect movement of the particles and producing a signal whenever the degree of movement changes to a predetermined degree.

8. The method of claim 7 wherein vibration created by said movement is detected.

9. The method of claim 8 wherein the vibration monitored is sound vibration.

10. The method of claim 7 wherein the operation of a cell unit is adjusted in response to the signal produced by such a unit during continued operation of other monitored cell units.

11. The method of claim 10 wherein the adjustment is made to an individual cell unit while operation of other cell units are continued.

12. The method of claim 7 wherein each cell unit is individually monitored and produces an individual signal.

13. The method of claim 7 wherein individual spaced areas of a moving particle body in a cell unit are separately monitored.

14. The method of claim 7 wherein displacement of a solid caused by said movement is detected.

15. The method of claim 7 wherein the operation of a cell unit is adjusted in response to the signal produced by such a unit.

16. A method of monitoring the operation of an electrolytic cell having an electrode comprising a body of moving particles which comprises monitoring the impingement effect of electrode particles against a solid member and producing a signal whenever the effect changes to a predetermined degree.

17. The method of claim 16 wherein the effect is to displace the solid.

18. The method of claim 16 wherein the effect is vibration of the solid.

* * * * *